US008602005B2

(12) United States Patent
Ikeda

(10) Patent No.: US 8,602,005 B2
(45) **Date of Patent: *Dec. 10, 2013**

(54) MULTIPLE DISCHARGE PLASMA APPARATUS

(75) Inventor: Yuji Ikeda, Kobe (JP)

(73) Assignee: Imagineering, Inc., Kobe-shi, Hyogo (JP)

( * ) Notice: Subject to any disclaimer, the term of this patent is extended or adjusted under 35 U.S.C. 154(b) by 587 days.

This patent is subject to a terminal disclaimer.

(21) Appl. No.: 12/881,917

(22) Filed: Sep. 14, 2010

(65) Prior Publication Data

US 2011/0030660 A1 Feb. 10, 2011

Related U.S. Application Data

(63) Continuation-in-part of application No. PCT/JP2009/054965, filed on Mar. 13, 2009.

(30) Foreign Application Priority Data

Mar. 14, 2008 (JP) ..... 2008-066889

(51) Int. Cl.
*F02B 51/00* (2006.01)

(52) U.S. Cl.
USPC ..... 123/536; 123/537; 123/538; 123/539; 123/143 R; 123/143 B; 123/169 EL

(58) Field of Classification Search
USPC ..... 123/536–539, 143 R, 143 B, 169 EL
See application file for complete search history.

(56) References Cited

U.S. PATENT DOCUMENTS 3,934,566 A 1/1976 Ward
4,138,980 A 2/1979 Ward (Continued)

FOREIGN PATENT DOCUMENTS

JP 51-77719 A 7/1976
JP 57-119164 A 7/1982

(Continued)

OTHER PUBLICATIONS

International Search Report of PCT/JP2009/054965, mailing date Jun. 9, 2009.

(Continued)

*Primary Examiner* — Marguerite McMahon
*Assistant Examiner* — James Kim
(74) *Attorney, Agent, or Firm* — Westerman, Hattori, Daniels & Adrian, LLP

(57) ABSTRACT

A multiple discharge plasma apparatus is provided with a plurality of discharge devices, each with an electrode exposed to the combustion chamber and installed in at least one of members constituting the combustion chamber; an antenna installed in at least one of the members constituting the combustion chamber so as to radiate electromagnetic waves to the combustion chamber; an electromagnetic wave transmission line installed in at least one of the members constituting the combustion chamber, with one end connected to the antenna and the other end covered with an insulator or dielectric and extending to a portion, of at least one of the members constituting the combustion chamber, distant from the combustion chamber; and an electromagnetic wave generator for feeding electromagnetic waves into the electromagnetic wave transmission line; wherein the multiple discharge plasma apparatus is configured such that discharge is generated by the electrodes of a plurality of discharge devices and the electromagnetic waves fed from the electromagnetic wave generator through the electromagnetic wave transmission line is radiated from antenna, during the compression stroke.

6 Claims, 14 Drawing Sheets

(56) References Cited

U.S. PATENT DOCUMENTS

| | | | | |
|---|---|---|---|---|
| 4,726,336 | A * | 2/1988 | Hoppie et al. | 123/292 |
| 4,926,001 | A | 5/1990 | Alagy et al. | |
| 5,027,764 | A * | 7/1991 | Reimann | 123/143 B |
| 5,270,515 | A | 12/1993 | Long | |
| 5,288,969 | A | 2/1994 | Wong et al. | |
| 5,418,430 | A | 5/1995 | Bayliss | |
| 5,490,973 | A | 2/1996 | Grothaus et al. | |
| 5,568,801 | A * | 10/1996 | Paterson et al. | 123/598 |
| 5,646,489 | A | 7/1997 | Kakehi et al. | |
| 5,750,823 | A | 5/1998 | Wofford et al. | |
| 5,845,480 | A | 12/1998 | DeFreitas et al. | |
| 6,007,742 | A | 12/1999 | Czernichowski et al. | |
| 6,029,602 | A | 2/2000 | Bhatnagar | |
| 6,329,628 | B1 | 12/2001 | Kuo et al. | |
| 6,545,420 | B1 | 4/2003 | Collins et al. | |
| 6,581,581 | B1 * | 6/2003 | Bebich | 123/536 |
| 6,806,439 | B2 | 10/2004 | Uhm et al. | |
| 6,888,040 | B1 | 5/2005 | Shufflebotham et al. | |
| 8,365,707 | B2 * | 2/2013 | Ikeda | 123/536 |
| 2003/0206833 | A1 | 11/2003 | Obee et al. | |
| 2007/0209634 | A1 * | 9/2007 | Minami | 123/310 |

FOREIGN PATENT DOCUMENTS

| | | | |
|---|---|---|---|
| JP | 57-148022 | A | 9/1982 |
| JP | 7-012037 | A | 1/1995 |
| JP | 2000-179412 | A | 6/2000 |
| JP | 2000-325734 | A | 11/2000 |
| JP | 2001-300296 | A | 10/2001 |
| JP | 2002-195151 | A1 | 7/2002 |
| JP | 2002-295259 | A | 10/2002 |
| JP | 2002-295264 | A | 10/2002 |
| JP | 2004-216231 | A | 8/2004 |
| JP | 2005-171812 | A | 6/2005 |
| JP | 2005-246353 | A | 9/2005 |
| JP | 2005-319357 | A | 11/2005 |
| JP | 2006-132518 | A | 5/2006 |
| JP | 2006-187766 | A | 7/2006 |
| JP | 2007-113570 | A | 5/2007 |
| JP | 2007-270824 | A | 10/2007 |
| JP | 2008-036080 | A | 2/2008 |
| WO | 2007/048994 | A1 | 5/2007 |
| WO | 2008/035448 | A1 | 3/2008 |

OTHER PUBLICATIONS

International Search Report of PCT/JP2008/062637, mailing date of Aug. 5, 2008.

McAdams, "Prospects for non-thermal atmospheric plasmas for pollution abatement"; Journal of Physics D: Applied Physics. 34 (2001); pp. 2810-2821.

Mizeraczyk et al., "Hazardous gas treatments using atmospheric pressure microwave discharges"; Plasma Physics and Controlled Fusion, 47 (2005), pp. B589-B602.

Uhm et al., "A microwave plasma torch and its applications"; Plasma Sources Science and Technology 15 (2006), pp. S26-S34.

International Search Report of PCT/JP2008/062642, mailing date of Sep. 2, 2008.

* cited by examiner

MULTIPLE DISCHARGE PLASMA APPARATUS

TECHNICAL FIELD

The present invention belongs to the field of the internal combustion engine and relates to the improvement of combustion in the combustion chamber of an internal combustion engine.

BACKGROUND OF THE INVENTION

Patent Document 1 shows an internal combustion engine including a combustion/reaction chamber, auto-ignition means, microwave radiation means, and control means. The combustion/reaction chamber consists of a cylinder and piston. The combustion/reaction chamber is supplied with a mixture of reactive and oxidation gas. In the combustion/reaction chamber, a plasma reaction of the mixture is carried out. The auto-ignition means automatically ignites the mixture by injecting a mixture of reactive and oxidation gas under high pressure, compressing the mixture and increasing the temperature. The microwave radiation means radiates the combustion/reaction chamber with microwaves. The control means controls the auto-ignition means and microwave radiation means, and repeats a cycle that involves radiating the combustion/reaction chamber with microwaves so that large amounts of hydroxyl (OH) radicals and ozone ($O_3$) are generated from the moisture in the combustion/reaction chamber mixture, which then oxidizes and reacts chemically, combustion of the mixture in the combustion/reaction chamber is promoted by the large amount of OH radicals and $O_3$, when the auto-ignition, means ignites the mixture.

The internal-combustion engine with an electrical field formed in the combustion chamber is disclosed in Patent Documents 2 to 4. Patent Document 2 outlines an internal combustion engine, containing the following: a cylinder block with a cylinder wall; a cylinder head on the cylinder block; a piston in the cylinder block; a combustion chamber formed by the cylinder wall, cylinder head and piston; and an electrical field apply means for applying an electrical field in the combustion chamber during combustion of the engine. When an electrical field is applied to the flame in this internal combustion engine, ions move into the flame and collide. This increases the flame propagation speed, and the ions in the gas that has already burnt move to unburnt gas and alter the chemical reaction in the unburnt gas. This maintains a uniform flame temperature and controls engine knock.

[Patent Document 1] Japanese Patent Application Laid-open Publication No. 2007-113570

[Patent Document 2] Japanese Patent Application Laid-open Publication No. 2000-179412

[Patent Document 3] Japanese Patent Application Laid-open Publication No. 2002-295259

[Patent Document 4] Japanese Patent Application Laid-open Publication No. 2002-295264

SUMMARY OF THE INVENTION

The inventor of the present invention extrapolated the mechanism of combustion promotion in the internal combustion engine which is disclosed in Patent Document 1, and obtained a constant finding about the mechanism. In this mechanism, a small amount of plasma is discharged firstly. The plasma is irradiated with microwaves for a given period of time, so that the amount of plasma increases. Thus a large amount of OH radicals and ozone is generated from moisture in the air-fuel mixture within a short period of time, promoting an air-fuel mixture reaction. This mechanism of the combustion promotion, obtained by generating a large amount of OH radicals and ozone, promotes combustion with plasma, is entirely different from combustion-promoting mechanisms that use ions to increase flame propagation speed, disclosed in Patent Documents 2 through 4.

In the view of the foregoing, the present invention has been achieved. An object of the invention is to provide a multiple discharge plasma apparatus which promotes combustion by generating a large amount of OH radicals and ozone with plasma at multiple places to improve combustion in the combustion chamber.

The present invention is plasma apparatus using a valve, which is installed in an internal combustion engine in which a piston fits into a cylinder penetrating a cylinder block to reciprocate freely, a cylinder head is assembled to the anti-crankcase side of the cylinder block with a gasket between it and the cylinder block, an intake port opening on the cylinder head is opened and closed with an intake valve, an exhaust port opening on the cylinder head is opened and closed with an exhaust valve, these parts form the combustion chamber, the multiple discharge plasma apparatus comprises, a plurality of discharge devices, each with an electrode exposed to the combustion chamber and installed in at least one of members constituting the combustion chamber, an antenna installed in at least one of the members constituting the combustion chamber so as to radiate electromagnetic waves to the combustion chamber, an electromagnetic wave transmission line installed in at least one of the members constituting the combustion chamber, with one end connected to the antenna and the other end covered with an insulator or dielectric and extending to a portion, of at least one of the members constituting the combustion chamber, distant from the combustion chamber, and an electromagnetic wave generator for feeding electromagnetic waves into the electromagnetic wave transmission line, wherein the multiple discharge plasma apparatus is configured such that discharge is generated by the electrodes of a plurality of discharge devices and the electromagnetic waves fed from the electromagnetic wave generator through the electromagnetic wave transmission line are radiated from antenna, during the compression stroke when the intake valve closes the intake port and the exhaust valve closes the exhaust port.

At the compression stroke in the actuation of the internal combustion engine, discharges are generated by the electrodes of a plurality of discharge devices and the electromagnetic waves fed from the electromagnetic wave generator through the electromagnetic wave transmission line are radiated from the antenna. Therefore, the plasma is generated near the electrodes. This plasma receives energy of an electromagnetic waves (electromagnetic wave pulse) supplied from the antenna for a given period of time. As a result, the plasma generates a large amount of OH radicals and ozone to promote the combustion. In fact electrons near the electrodes are accelerated, fly out of the plasma area, and collide with gas such as air or the air-fuel mixture in surrounding area of said plasma. The gas in the surrounding area is ionized by these collisions and becomes plasma. Electrons also exist in the newly formed plasma. These also are accelerated by the electromagnetic wave pulse and collide with surrounding gas. The gas ionizes like an avalanche and floating electrons are produced in the surrounding area by chains of these electron acceleration and collision with electron and gas inside plasma. These phenomena spread to the area around discharge plasma in sequence, then the surrounding area get into plasma state. In the result of the phenomena as mentioned above it, the volume of plasma increases. Then the electrons recombine rather than dissociate at the time when the electromagnetic wave pulse radiation is stopped. As a result, the electron density decreases, and the volume of plasma decreases as well. The plasma disappears when the electron recombination is completed. A large amount of OH radicals and ozone is generated from moisture in the gas mixture as a result of a large amount of the generated plasma, promoting the combustion of the mixture.

In this case, a large amount of plasma beginning at each electrode is generated, because there are multiple electrodes of said discharge devices. A large amount of OH radicals and ozone are generated from moisture etc. in the gas mixture as a result of these multiple plasma, promoting the combustion of the mixture.

Moreover, ignition is caused in the vicinity of the cylinder wall when the electrodes are installed in the vicinity of the cylinder wall. This deduces or prevents the generation of knocking, which originates in an uncertain factor such as pressure waves that reach the cylinder wall from the vicinity of the center of the combustion chamber.

The multiple discharge plasma apparatus of the present invention may be applicable for which the multiple discharge plasma apparatus is configured such that discharge is generated by a plurality of the electrodes of the discharge devices in sequence following a predefined schedule.

This makes it possible that a large amount of plasma is generated near each electrode. A large amount of OH radical and ozone are generated as a result of plasma. As a result, combustion of mixture is promoted in each place. These phenomena near each electrode are initiated in sequence following a predefined schedule. Therefore, high-speed ignitions or combustions such as the volume ignition are initiated in sequence, and combustion reaction progresses according to this schedule.

The multiple discharge plasma apparatus of the present invention may be applicable for which the multiple discharge plasma apparatus is configured such that discharge is generated by a plurality of the electrodes of the discharge devices sequentially with the same timing.

This makes it possible that a large amount of plasma is generated near each electrode. A large amount of OH radical and ozone are generated as a result of plasma. As a result, combustion of mixture is promoted in each place with the same timing.

The multiple discharge plasma apparatus of the present invention may be applicable for which the multiple electrodes are located close to multiple portions that electric field intensity generated by the electromagnetic waves strengthens in the antenna when the electromagnetic waves are fed into the antenna.

This makes it possible that the electrical field intensity, due to the electromagnetic waves radiated from said each portion of the antenna, is stronger than the electrical field intensity of the surrounding electromagnetic waves. Therefore, the energy of the electromagnetic wave pulse from said each portion near the plasma is intensively supplied to the plasma generated by discharge at each electrode. As a result, a large amount of OH radicals and ozone is efficiently generated, further promoting combustion in the area centered at each electrode.

DESCRIPTION OF REFERENCE CHARACTERS

Figure 1:
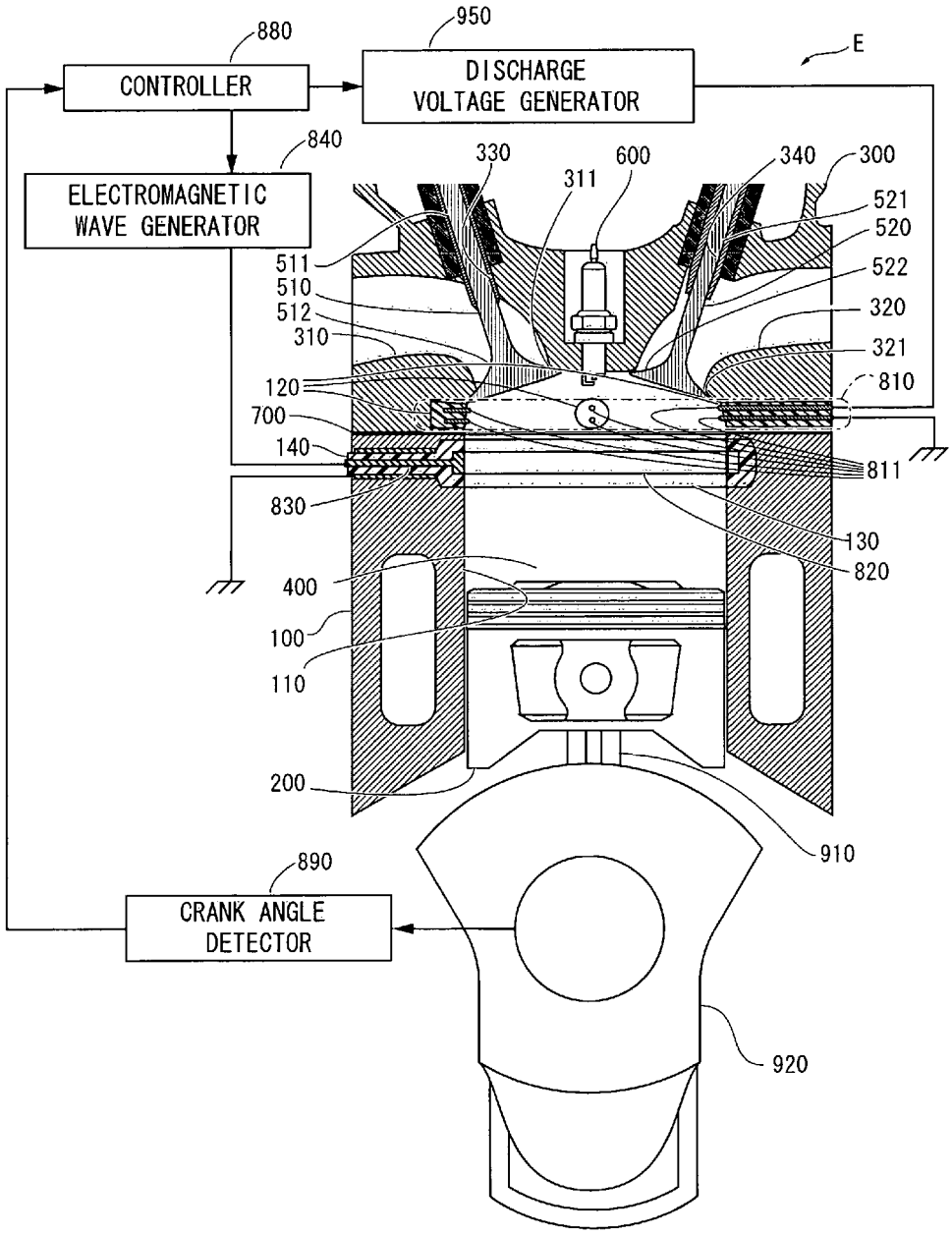
FIG. 1 shows a vertical cross-sectional view of combustion chamber in an internal combustion engine with the multiple discharge plasma apparatus in the first embodiment of the present invention.

E Internal combustion engine
100 Cylinder block
110 Cylinder
200 Piston
300 Cylinder head
320 Exhaust port
321 Opening
340 Guide hole
400 Combustion chamber
520 Exhaust valve
521 Valve stem
522 Valve head
700 Gasket

760,810 Discharge device
762,811 Electrode
770,820 Antenna
780,830 Electromagnetic wave transmission line
840 Electromagnetic wave generator

DETAILED DESCRIPTION OF THE INVENTION

Hereinafter, embodiments of the present invention will be described. FIG. 1 shows the embodiment of the internal combustion engine E comprising the multiple discharge plasma apparatus of the present invention. The present invention targets reciprocating engines. In this embodiment, engine E is a four-cycle gasoline engine. Item 100 is the cylinder block. Cylinder block 100 contains cylinder 110, which has an approximately circular cross section. Cylinder 110 penetrates cylinder block 100. Piston 200, which has an approximately circular cross section corresponding to cylinder 110, fits into cylinder 110 and reciprocates freely. Cylinder head 300 is assembled on the anti-crankcase side of cylinder block 100 with a gasket between it and the cylinder block 100. Cylinder head 300 has intake port 310, which is a component of the intake line, and exhaust port 320, which is a component of the exhaust line. One end of intake port 310 is open at the wall of cylinder head 300 face to the cylinder 110; the other end is open at the outside wall of cylinder head 300. One end of exhaust port 320 is open at the wall of cylinder head 300 face to the cylinder 110; the other end is open at the outside wall of cylinder head 300. Cylinder head 300 has guide hole 330 that passes through intake port 310 to the outside wall of cylinder head 300. Rod-shaped valve stem 511 of intake valve 510 fits into guide hole 330 and reciprocates freely. Umbrella-shaped valve head 512, set at the end of valve stem 511, opens and closes the combustion chamber side opening 311 of intake port 310 at a given timing by a valve open/close mechanism having a cam and so on (not shown in the figure). Cylinder head 300 has guide hole 340 that passes through exhaust port 320 to the outside wall of cylinder head 300. Rod-shaped valve stem 521 of exhaust valve 520 fits into guide hole 340 and reciprocates freely. Umbrella-shaped valve head 522, set at the end of valve stem 521, opens and closes the combustion chamber side opening 321 of the exhaust port 320 at a given time by the valve open/close mechanism having cam and so on (not shown in the figure). Item 910 is a connecting rod, with one end connected to piston 200 and the other end connected to crankshaft 920, which is the output shaft. Moreover, cylinder block 100, piston 200, gasket 700, cylinder head 300, intake valve 510, and exhaust valve 520 form combustion chamber 400. Item 600 is a spark plug installed in cylinder head 300 to expose the electrode to combustion chamber 400. Spark plug 600 discharges at the electrodes when piston 200 is near top dead center. Therefore, four strokes (intake, compression, combustion of mixture, and exhaust of exhaust gas) occur while piston 200 reciprocates between top dead center and bottom dead center twice. However, this embodiment does not restrict the interpretation of the internal combustion engine targeted by the present invention. The present invention is also suitable for use with two-stroke internal combustion engines and diesel engines. Target gasoline engines include direct-injection gasoline engines, which create a mixture inside the combustion chamber to inject fuel into the intake air. Target diesel engines include direct-injection diesel engines, which inject fuel into the combustion chamber directly, and divided-chamber diesel engines, which inject fuel into the divided chamber. Internal combustion engine E in this embodiment has four cylinders, but this does not restrict number of cylinders of the internal combustion engine targeted by the present invention. The internal combustion engine for this embodiment has two intake valves 510 and two exhaust valves 520, but this does not restrict the number of intake or exhaust valves of the internal combustion engine targeted by the present invention.

Figure 2:
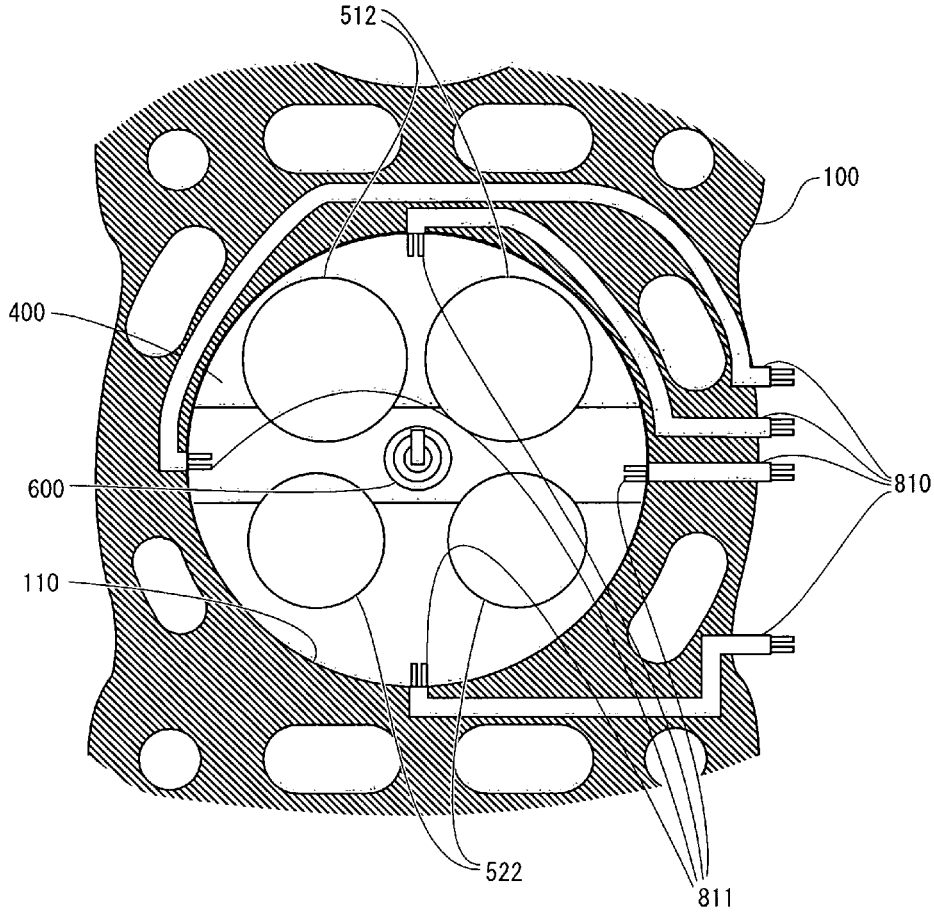
FIG. 2 shows an enlarged cross sectional view of the cylinder block in an internal combustion engine with the multiple discharge plasma apparatus in the first embodiment of the present invention, sectioned at the position of the electromagnetic wave transmission line.

The discharge device 810 with electrode 811 exposed to the combustion chamber 400 is installed in the cylinder block 100, as shown in FIGS. 1 and 2. The wall of cylinder 110 in cylinder block 110 contains a hole that penetrates the wall from cylinder side to the outside wall. The first support 120 with tube-shaped is installed in this hole. This first support 120 is made from ceramics. Like this, the first support 120 may be made from dielectric, but it may be made from insulator. One end face of this first support 120 is the same level with the cylinder 110 wall. This first support 120 is exposed to cylinder 110, and the other end of this first support 120 reaches the outside wall of cylinder block 100. And, discharge device 810 is installed in the first support 120. The discharge device 810 only has to be made from a conductor although it is made from the copper wire. A couple of discharge device 810 is buried in the first support 120, and it goes though the first support 120. The end face of each discharge device 810 is the same level with the wall of the cylinder 110. The end face of each discharge device 810 exposes to cylinder 110 and composes electrode 811. The other end of each discharge device 810 is extracted from the outside wall of cylinder block 100 to outside. In one of a pair discharge devices 810, the end portion that exposed from the outside wall of cylinder block is connected to discharge voltage generator 950 which generates voltage for discharge. In another of a pair discharge devices 810, the end portion that exposed from the outside wall of cylinder block is earthed. Here, the discharge voltage generator discharge 950 is DC 12V power supply, but it may be used for example piezo element or other device. When the discharge voltage generator 950 applies the voltage between a pair of discharge devices 810, the discharge is generated between a pair of electrodes 811. As a modification, the number of the discharge line, buried and passes thorough the first support, may be one. In this case, the discharge voltage generator is connected with the discharge line, and the voltage is applied with the discharge voltage generator between the discharge line and cylinder blocks which is the earth member. Then, the discharge is generated between the electrode of the discharge line and the cylinder block. In this embodiment, four discharge lines are installed, these are arranged so that their four electrodes are located at approximately equal intervals to the circumferential direction of cylinder 110, as shown in FIG. 2. However, this multiple plasma apparatus requires only more than one discharge device installation, and number of discharge devices and its location are not cause of restrict interpretation by this embodiment. In this embodiment, part of discharge line 810 except the electrode and the electrode 811 are formed from the same material as one body. However, part of discharge line except the electrode and the electrode are formed separately and connected. Part of discharge line 760 except the electrode and the electrode are made from the different material. The spark plug can be used as a discharge device. The discharge device requires generating plasma by discharge regardless the size.

Figure 3:
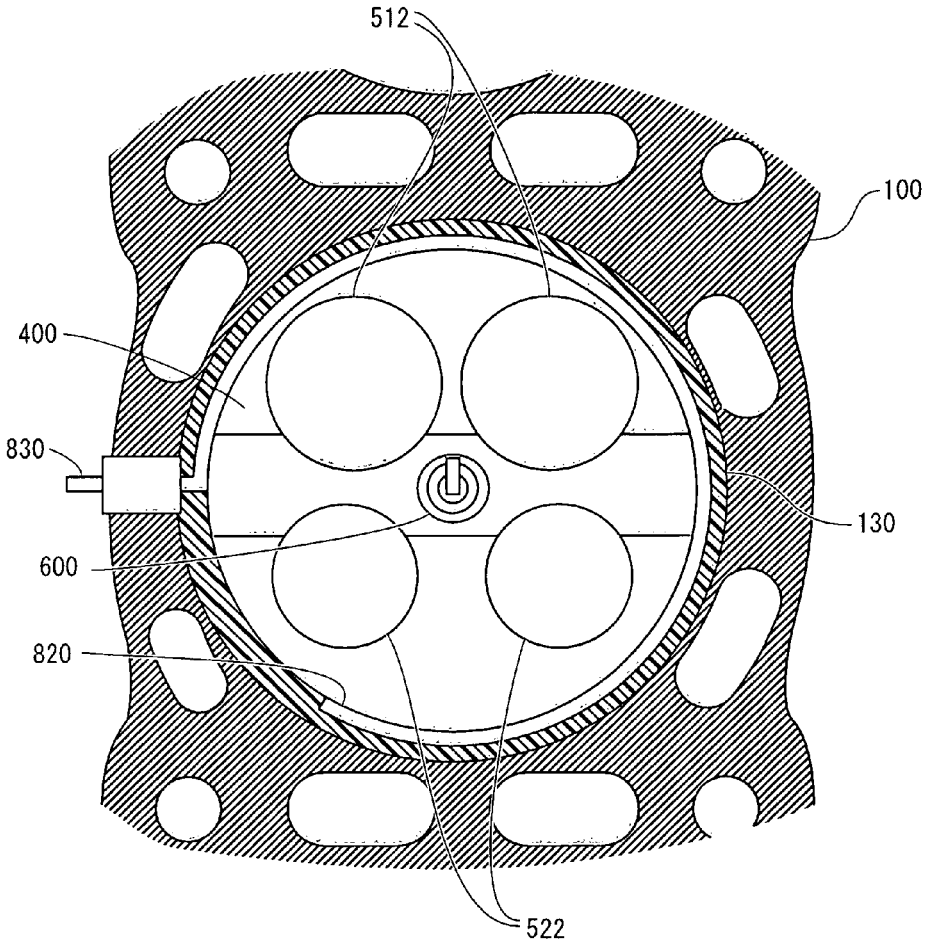
FIG. 3 shows an enlarged cross sectional view of the cylinder block in an internal combustion engine with the multiple discharge plasma apparatus in the first embodiment of the present invention, sectioned at the position of the antenna.

Antenna 820 is installed in cylinder block 100 to radiate the electromagnetic waves into combustion chamber 400, as shown in FIGS. 1 and 3. The groove that dents in the direction where the radius of cylinder 110 expands and extends in circumferential direction of cylinder 110 is installed on the wall of cylinder 110 in cylinder block 100. The second support 130 is installed in this groove, and it orbits in circumferential direction to be ring-shaped. This second support 130 is made from ceramics. Although the second support 130 could be formed from the dielectric substance, also could be formed from insulator. An inner side wall of second support 130 is at the same level with the cylinder 110 wall and it is exposed to cylinder 110. And, antenna 820 is installed in the second support 130. This antenna 820 is made from metal. This antenna 820 may be made from conductor or dielectric or insulator and so on. However, electromagnetic waves must be radiated from the antenna to the combustion chamber well upon supplying electromagnetic waves between the antenna and the earth member. This antenna 820 is bar-style, and has almost curved to a circular arc type along the wall of cylinder 110. For example, the length of the antenna 820 is set to a quarter of wavelength in electromagnetic waves, standing wave is generated in the antenna 820. Thus, electrical field strength at the end of antenna 820 becomes strong. For example, the length of the antenna 820 is set to a multiple of a quarter wavelengths of the electromagnetic waves so that standing waves are generated in the antenna 820, increasing the electrical field at multiple points, where the anti-nodes of the standing waves are generated, in the antenna 820. Here, antenna 820 is buried in the second support 130. An inner surface of antenna 820 is the same level of the cylinder wall of 110 and is exposed to cylinder 110. As shown in FIG. 1, the solid cross-section of antenna 820 is approximately rectangle for its entire length. Antenna 820 is exposed to cylinder 100 at one side on the circumference of circle or its entire length. However, antenna 820 of the multiple discharge plasma apparatus of the present invention is not restricted to a rectangle cross-sectional shape. Antenna 820 may be completely buried in the second support. Additionally, the electrode 811 is located close to a portion that electric field intensity generated by the electromagnetic waves becomes strong in the antenna 820 when the electromagnetic waves are fed to the antenna 820. In here, the end of antenna 820 and the electrode 811 are close to each other along the wall of combustion chamber 400 at specified intervals. Thus, when electromagnetic waves are supplied between antenna 820 and said earth cylinder block 100, the electromagnetic waves are radiated from antenna 820 into combustion chamber 400. For this embodiment, antenna 820 is a rod-shaped monopole antenna that is curved one. However, this does not restrict the type of antenna in the multiple discharge plasma apparatus of the present invention. Therefore, antenna of the multiple discharge plasma apparatus of the present invention may be dipole type, Yagi-Uda type, single wire type, loop type, phase difference feeder type, grounded type, ungrounded and perpendicular type, beam type, horizontal polarized omni-directional type, corner-reflector type, comb type or other type of linear antenna, microstrip type, planar inverted F type or other type of flat antenna, slot type, parabola type, horn type, horn reflector type, Cassegrain type or other type of solid antenna, Beverage type or other type of traveling-wave antenna, star EH type, bridge EH type or other type of EH antennas, bar type, small loop type or other type of magnetic antenna, or dielectric antenna.

Electromagnetic wave transmission line 830 is installed in cylinder block 100. One of the electromagnetic wave transmission lines 830 is connected with the antenna 820. The other end of electromagnetic wave transmission line 830 is covered with a dielectric, and extends to a portion of the cylinder block 100, distant from the combustion chamber 400. The wall of cylinder 110 in cylinder block 110 contains a hole that penetrates the wall from periphery side of second support 130 to the outside wall. The third support 140 with tube-shaped is installed in this hole. This third support 140 is made from ceramics. Like this, the third support 140 may be made from dielectric, but it may be made from insulator. One of the third support 140 ends is connected with a side which is farther from cylinder 110 on the second support 130. The other end of the third support 140 reaches the outside wall of cylinder block 100. And electromagnetic wave transmission line 830 is installed in the third support 140. The electromagnetic wave transmission line 830 is made from copper wire. The electromagnetic wave transmission line 830 may be made from conductor, dielectric, or insulator and so on. However, electromagnetic waves must be transmitted well to the antenna 820 upon supplying electromagnetic waves between the earthed member and the electromagnetic wave transmission line. A variation example of the electromagnetic waves transmission line is an electromagnetic waves transmission line which consists of a waveguide made from conductor or dielectric. Here, the electromagnetic wave transmission line 830 is buried in the third support 140, and pass through the third support 140. One end of the electromagnetic wave transmission line 830 is connected with the antenna 820. The other end of the electromagnetic wave transmission line 830 is extracted from the outside wall of cylinder block 100 to outside. Thus, when electromagnetic waves are supplied between electromagnetic wave transmission line 830 and cylinder block 100 that is the earth member, they are introduced into antenna 820.

Electromagnetic wave generator 840 supplies the electromagnetic waves to transmission line 830, and is installed in internal combustion engine E or its surroundings. Electromagnetic wave generator 840 in this embodiment is a magnetron that generates 2.4-GHz-bandwidth microwaves. However, this does not restrict the construction of the electromagnetic wave generator of the multiple discharge plasma apparatus in the present invention.

Figure 4:
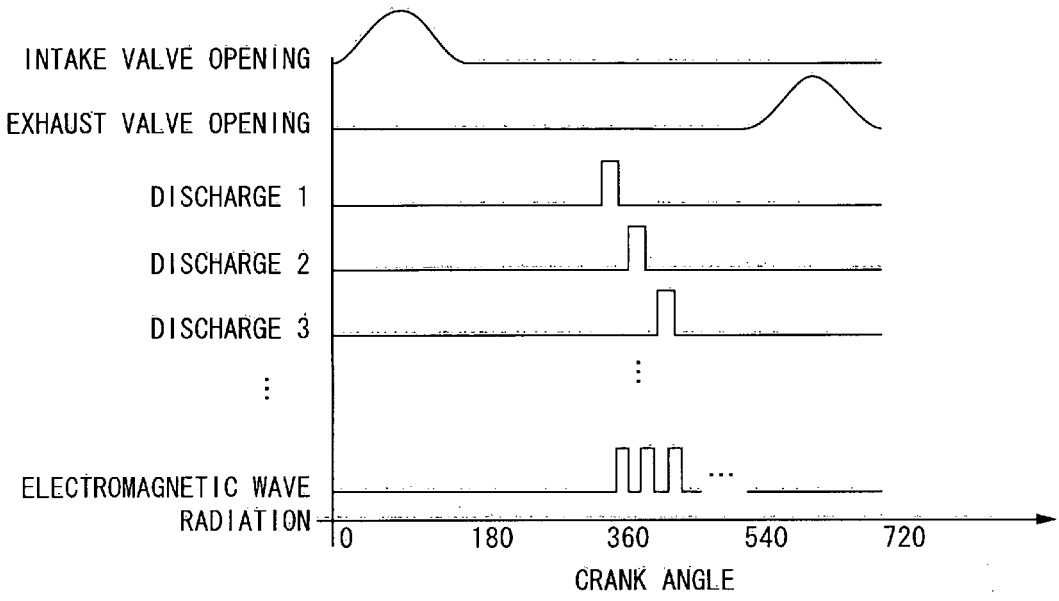
FIG. 4 shows an explanation chart which explains the operation of the multiple discharge plasma apparatus in the first embodiment of the present invention, sectioned at the position of the antenna.

In this multiple discharge plasma apparatus, discharge is generated between the electrodes of a plurality of discharge devices, and electromagnetic waves fed from the electromagnetic wave generator through the electromagnetic wave transmission line are radiated from the antenna 820, at the compression stroke when the intake valves closes the intake ports and the exhaust valves closes the exhaust ports. In the multiple discharge plasma apparatus in this embodiment, discharge is generated by a plurality of the electrodes 811 of the discharge devices 810 in sequence following a predefined schedule (Refer to FIG. 4). Cylinder block 100 is earthed. The earth terminals of discharge voltage generator 950 and electromagnetic wave generator 840 are earthed. Discharge voltage generator 950 and electromagnetic wave generator 840 are controlled by controller 880, which has a CPU, memory, and storage etc, and outputs control signals after computing input signals. A signal line from crank angle detector 890 for detecting crank angle of crankshaft 920 is connected to control unit 880. Crank angle detection signals are sent from crank angle detector 890 to controller 880. Therefore, controller 880 receives signals from crank angle detector 890 and controls the actuations of discharge device 810 and electromagnetic wave generator 840. However, this does not restrict the control method and the composition of the input-output signals as for the multiple discharge plasma apparatus of the present invention.

As a modification, there is a multiple discharge plasma apparatus that is configured such that discharge is generated by a plurality of the electrodes 810 of the discharge devices 810 sequentially with the same timing.

At the compression stroke in the actuation of the internal combustion engine E, discharges are generated by the electrodes of a plurality of discharge devices 810 and the electromagnetic waves fed from the electromagnetic wave generator 840 through the electromagnetic wave transmission line 830 are radiated from the antenna 820. Therefore, the plasma is generated near electrodes 811. This plasma receives energy of an electromagnetic waves (electromagnetic wave pulse) supplied from the antenna 820 for a given period of time. As a result, the plasma generates a large amount of OH radicals and ozone to promote the combustion. In fact electrons near electrodes are accelerated, fly out of the plasma area, and collide with gas such as air or the air-fuel mixture in surrounding area of said plasma. The gas in the surrounding area is ionized by these collisions and becomes plasma. Electrons also exist in the newly formed plasma. These also are accelerated by the electromagnetic wave pulse and collide with surrounding gas. The gas ionizes like an avalanche and floating electrons are produced in the surrounding area by chains of these electron acceleration and collision with electron and gas inside plasma. These phenomena spread to the area around discharge plasma in sequence, then the surrounding area get into plasma state. In the result of the phenomena as mentioned above it, the volume of plasma increases. Then the electrons recombine rather than dissociate at the time when the electromagnetic wave pulse radiation is stopped. As a result, the electron density decreases, and the volume of plasma decreases as well. The plasma disappears when the electron recombination is completed. A large amount of OH radicals and ozone is generated from moisture in the gas mixture as a result of a large amount of the generated plasma, promoting the combustion of the mixture.

In this case, a large amount of plasma beginning at each electrode 811 is generated, because there are multiple electrodes 811 of said discharge devices 810. A large amount of OH radicals and ozone are generated from moisture etc. in the gas mixture as a result of these multiple plasma, promoting the combustion of the mixture.

Moreover, ignition is caused in the vicinity of the cylinder wall when the electrodes 811 are installed in the vicinity of the cylinder wall. This deduces or prevents the generation of knocking, which originates in an uncertain factor such as pressure waves that reach the cylinder wall from the vicinity of the center of the combustion chamber.

In the multiple discharge plasma apparatus of the present invention, the order of operating the electrical discharge device etc. is not restricted. In the multiple discharge plasma apparatus in first embodiment discharge is generated by a plurality of the electrodes of the discharge devices in sequence following a predefined schedule. This makes it possible that a large amount of plasma is generated near each electrode 811. A large amount of OH radical and ozone are generated as a result of plasma. As a result, combustion of mixture is promoted in each place. These phenomena near each electrode 811 are initiated in sequence following a predefined schedule. Therefore, high-speed ignitions or combustions such as the volume ignition are initiated in sequence, and combustion reaction progresses according to this schedule.

Moreover, when discharge is generated by a plurality of the electrodes 811 of the discharge devices 810 sequentially with the same timing, a large amount of plasma is generated near each electrode 811 with the same timing. A large amount of OH radical and ozone are generated as a result of plasma with the same timing. As a result, combustion of mixture is promoted in each place with the same timing.

The positional relationship between the antenna and the electrodes is not restricted in the multiple discharge plasma apparatus of the present invention. Multiple electrodes 811 are respectively located close to a portion of strong electrical field intensity in the antenna 820 due to the electromagnetic waves when the electromagnetic waves are fed to the antenna 820 in the first embodiment among such varied embodiments. This makes it possible that the electrical field intensity, due to the electromagnetic waves radiated from said each portion of the antenna 820, is stronger than the electrical field intensity of the surrounding electromagnetic waves. Therefore, the energy of the electromagnetic wave pulse is intensively supplied to the plasma generated by discharge at the electrodes 811. As a result, a large amount of OH radicals and ozone is efficiently generated, further promoting combustion in the area centered at the electrodes 811.

Next, other embodiments of the multiple discharge plasma apparatus of the present invention will be described. In the multiple discharge plasma apparatus in first embodiment, discharge devices 810, antenna 820, and electromagnetic wave transmission line 830 were installed in the cylinder block 100 of the members constituting the combustion chamber 400. In the multiple discharge plasma apparatus in second embodiment, discharge devices 760, antenna 770, and electromagnetic wave transmission line 780 were installed in the gasket 700 of the members constituting the combustion chamber 400.

Figure 5:
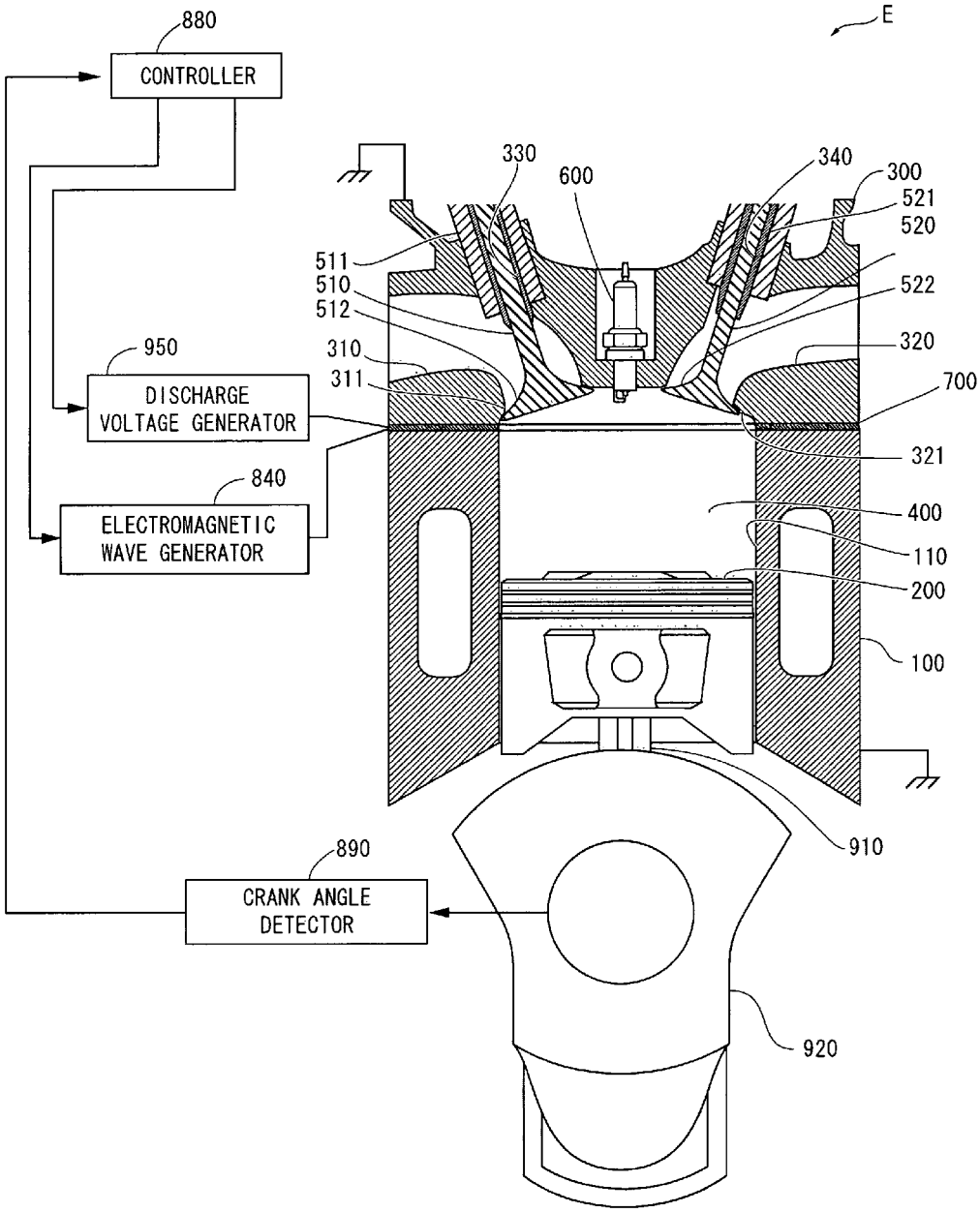
FIG. 5 shows a vertical cross-sectional view of combustion chamber in an internal combustion engine with the gasket provided with the multiple discharge plasma apparatus in the second embodiment of the present invention.

Hereinafter, second embodiments, including modifications, of the multiple discharge plasma apparatus will be described. FIG. 5 shows the embodiment of the internal combustion engine E comprising the gasket 700. The present invention targets reciprocating engines. In this embodiment, engine E is a four-cycle gasoline engine. Item 100 is the cylinder block. Cylinder block 100 contains cylinder 110, which has an approximately circular cross section. Cylinder 110 penetrates cylinder block 100. Piston 200, which has an approximately circular cross section corresponding to cylinder 110, fits into cylinder 110 and reciprocates freely. Cylinder head 300 is assembled on the anti-crankcase side of cylinder block 100. Cylinder head 300, piston 200, and cylinder 110 form combustion chamber 400. Item 910 is a connecting rod, with one end connected to piston 200 and the other end connected to crankshaft 920, which is the output shaft. Cylinder head 300 has intake port 310, which is a component of the intake line, and exhaust port 320, which is a component of the exhaust line. One end of intake port 310 connects to combustion chamber 400; the other end is open at the outside wall of cylinder head 300. One end of exhaust port 320 connects to combustion chamber 400; the other end is open at the outside wall of cylinder head 300. The cylinder head has guide hole 330 that passes through intake port 310 to the outside wall of cylinder head 300. The valve stem 511 of intake valve 510 fits into guide hole 330 and reciprocates freely. The valve head 512, set at the end of valve stem 511, opens and closes the combustion chamber side opening 311 of intake port 310 at a given timing by a valve open/close mechanism having a cam and so on (not shown in the figure). Cylinder head 300 has guide hole 340 that passes through exhaust port 320 to the outside wall of cylinder head 300. The valve stem 521 of exhaust valve 520 fits into guide hole 340 and reciprocates freely. Valve head 522, set at the end of valve stem 521, opens and closes the combustion chamber side opening 321 of the exhaust port 320 at a given time by the valve open/close mechanism having cam and so on (not shown in the figure). Item 600 is a spark plug installed in cylinder head 300 to expose the electrode to combustion chamber 400. Spark plug 600 discharges at the electrodes when piston 200 is near top dead center. Therefore, four strokes (intake, compression, combustion of mixture, and exhaust of exhaust gas) occur while piston 200 reciprocates between top dead center and bottom dead center twice. However, this embodiment does not restrict the interpretation of the internal combustion engine targeted by the present invention. The present invention is also suitable for use with two-stroke internal combustion engines and diesel engines. Target gasoline engines include direct-injection gasoline engines, which create a mixture inside the combustion chamber to inject fuel into the intake air. Target diesel engines include direct-injection diesel engines, which inject fuel into the combustion chamber directly, and divided-chamber diesel engines, which inject fuel into the divided chamber. Internal combustion engine E in this embodiment has four cylinders, but this does not restrict number of cylinders of the internal combustion engine targeted by the present invention. The internal combustion engine for this embodiment has two intake valves 510 and two exhaust valves 520, but this does not restrict the number of intake or exhaust valves of the internal combustion engine targeted by the present invention.

Figure 6:
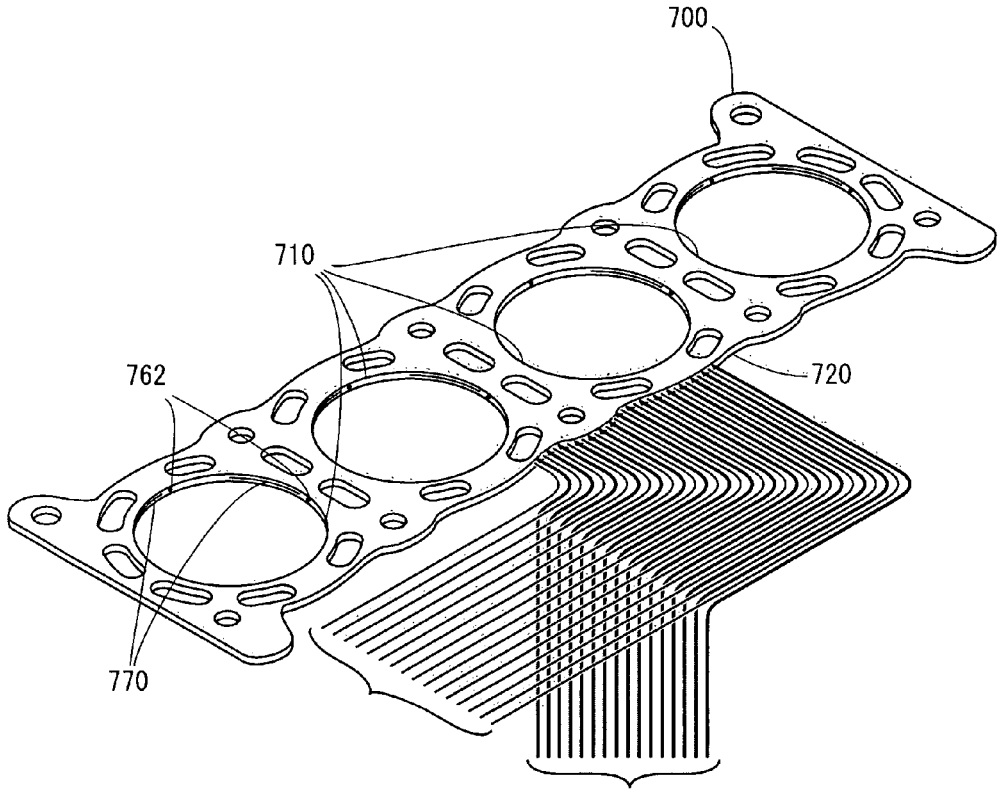
FIG. 6 shows a diagrammatic perspective view of the multiple discharge plasma apparatus in the second embodiment of the present invention.

Gasket 700, shown in FIG. 6, is installed between cylinder block 100 and cylinder head 300. Gasket 700 is shaped like a thin board with an almost constant thickness. Gasket 700 has an opening 710 corresponding to cylinder 110. Additionally, gasket 700 has holes corresponding to the water jacket and bolt holes. These do not restrict interpretation of the gasket shape targeted by the present invention.

Figure 7:
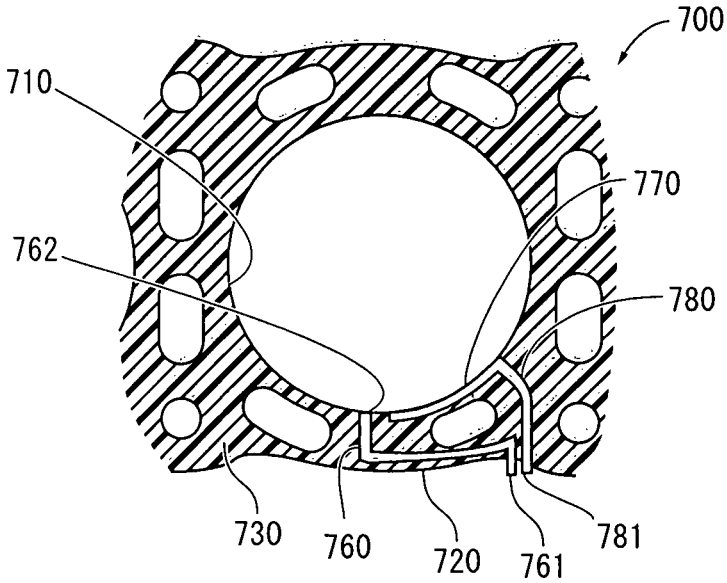
FIG. 7 shows a cross-sectional view along the surface, seen from thickness direction, of the gasket of near one opening of the gasket provided with the multiple discharge plasma apparatus in the second embodiment of the present invention.
Figure 8:
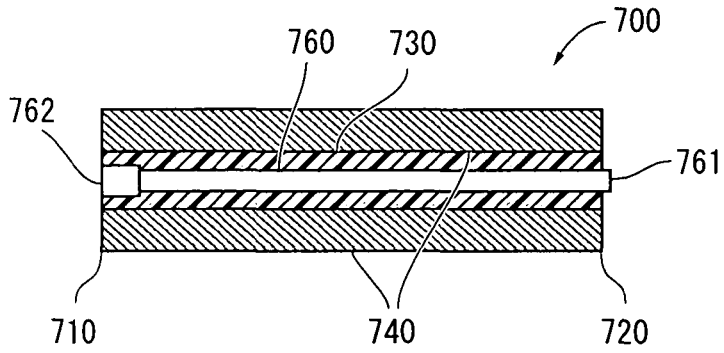
FIG. 8 shows an enlarged vertical cross-sectional view, along the discharge line, of the gasket provided with the multiple discharge plasma apparatus in the second embodiment of the present invention.

As shown in FIGS. 7 and 8, discharge line 760 is installed in intermediate layer 730 of gasket 700 in thickness direction as a discharge device. The intermediate layer 730 in thickness direction is a layer formed in the middle part of the direction of thickness. The intermediate layer 730 is made from ceramics. Intermediate layer can also be made from synthetic rubbers, fluoroplastics, silicone resin, synthetic resin, such as a meta system of aramid fiber seats, and heatproof paper. Thus, the intermediate layer may be made from a dielectric, but made from an insulator. Discharge line 760 is made from copper line, but may be made from another conductive material. Discharge line 760 is buried between outer peripheral edge 720 and opening 710 of gasket 700. The outside edge of discharge line 760 is exposed from outer peripheral edge 720 of gasket 700 to become first connector 761. Moreover, the inside edge of the discharge line 760 is exposed from the outer edge of the gasket 700 towards the center of opening 710 to become electrode 762. Surface layers 740, which exist on both sides of intermediate layer 730 in thickness direction, are made from a conductive material. One surface layer 740 comes in contact with one surface of cylinder block 100 when gasket 700 is installed between cylinder block 100 and cylinder head 300. The other surface layer 740 comes in contact with one surface of cylinder head 300. Surface layers 740 are made from metal, although they could also be made from other materials. Although both surface layers 740 in thickness direction are made from a conductive material in this embodiment, the present invention includes the case in which only one surface layer to the intermediate layer 730 in thickness direction is made from a conductive material. Therefore, when the cylinder block 100, cylinder head 300 or surface layer 740 is earthed, and voltage is applied between first connector 761 and an earth member, which can be the cylinder block 100, cylinder head 300 or surface layers 740, a discharge is generated between first connector 761 and the earth member. In this embodiment, part of discharge line 760 except the electrode and the electrode are formed from the same material as one body. However, part of discharge line except the electrode and the electrode are formed separately and connected. Part of discharge line 760 except the electrode and the electrode are made from the different material.

Figure 9:
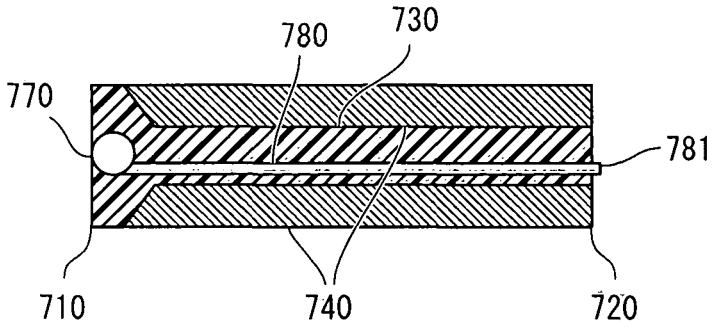
FIG. 9 shows an enlarged vertical cross-sectional view, along the electromagnetic wave transmission line, of the gasket provided with the multiple discharge plasma apparatus in the second embodiment of the present invention.

As shown in FIGS. 7 and 9, antenna 770 is installed in gasket 700. Antenna 770 is made from metal, although it could also be made from any conductive material, insulator, or dielectric provided that electromagnetic waves radiate well from the antenna to the combustion chamber when they are applied between the antenna and the earthed members. Antenna 770 is installed in gasket intermediate layer 730 in thickness direction at the inner peripheral edge around opening 710 to radiate electromagnetic waves to the combustion chamber 400. Antenna 770 is rod-shaped. Its base end is installed in intermediate layer 730 in thickness direction. A part to leading end except said base end in this antenna 770 is curved in a nearly circular arc. Antenna 770 extends along the inner peripheral edge around the opening 710 in the circumferential direction of the opening 710. For example, the length of the circular arc part of antenna 770 is set to a quarter of the wavelength of the electromagnetic waves so that standing waves are generated in the antenna 770, increasing the electrical field strength at the end of the antenna 770. For example, the length of the circular arc part of antenna 770 is set to a multiple of a quarter wavelengths of the electromagnetic waves so that standing waves are generated in the antenna 770, increasing the electrical field at multiple points, where the anti-nodes of the standing waves are generated, in the antenna 770. Here, the entire length of antenna 770 is almost buried in intermediate layer 730. As shown in FIG. 9, the solid cross-section of antenna 770 is approximately circular for its entire length. The antenna 770 contacts a surface which is an inner edge of opening 710 of intermediate layer 730 from the inside at one concyclic point in the section along its entire length. This part of antenna 770 is exposed from the inner edge of opening 710 to combustion chamber 400 on the section. However, antenna 770 of the present invention is not restricted to a circular cross-sectional shape. Antenna 770 may be buried in intermediate layer 730 completely. Additionally, said electrode 762 is located close to a portion of strong electrical field intensity in the antenna 770 due to the electromagnetic waves when the electromagnetic waves are fed to the antenna 770. Here, the leading end of antenna 770 and electrode 762 are close to each other along the inner peripheral edge of opening 710, with a prescribed gap between them. As a result, a stripline track is formed. Thus, when electromagnetic waves are supplied between first connector 761 and said earth member, the electromagnetic waves are radiated from antenna 770 to combustion chamber 400. The earth member may double as the earth side of the stripline track concurrently. For this embodiment, antenna 770 is a rod-shaped monopole antenna that is curved one. However, this does not restrict the type of antenna in the gasket of the present invention. Therefore, antenna of the gasket of the present invention may be dipole type, Yagi-Uda type, single wire type, loop type, phase difference feeder type, grounded type, ungrounded and perpendicular type, beam type, horizontal polarized omni-directional type, corner-reflector type, comb type or other type of linear antenna, microstrip type, planar inverted F type or other type of flat antenna, slot type, parabola type, horn type, horn reflector type, Cassegrain type or other type of solid antenna, Beverage type or other type of traveling-wave antenna, star EH type, bridge EH type or other type of EH antennas, bar type, small loop type or other type of magnetic antenna, or dielectric antenna.

As shown in FIGS. 7 and 9, electromagnetic wave transmission line 780 is installed in intermediate layer 730 of gasket 700 in thickness direction. Electromagnetic wave transmission line 780 is made from copper line, although it could also be made from any conductive material, insulator, or dielectric provided that electromagnetic waves are transmitted well to the antenna 770 when they are supplied between the antenna and the earthed member. An example of a variation of the electromagnetic wave transmission line is one that consists of a waveguide made from a conductive material or dielectric. Electromagnetic wave transmission line 780 is buried between outer peripheral edge 720 and opening 710 in gasket 700. The outside edge of electromagnetic wave transmission line 780 is exposed from outer peripheral edge 720 of gasket 700 to become second connector 781. The inside edge of electromagnetic wave transmission line 780 connects with antenna 770 in intermediate layer 730. Thus, the electromagnetic waves are led to antenna 770 when electromagnetic waves are supplied between second connector 781 and the earthed member.

Gasket 700 electrically insulates discharge line 760, antenna 770, electromagnetic wave transmission line 780, and both surfaces of the gasket in thickness direction. Cylinder block 100, cylinder head 300, or surface layer 740 is earthed. The anode of discharge voltage generator 950 is connected to first connector 761. The anode of electromagnetic wave generator 840 is connected to second connector 781. The earth terminals of discharge voltage generator 950 and electromagnetic wave generator 840 are earthed. Discharge voltage generator 950 and electromagnetic wave generator 840 are controlled by controller 880, which has a CPU, memory, and storage etc, and outputs control signals after computing input signals. A signal line from crank angle detector 890 for detecting crank angle of crankshaft 920 is connected to control unit 880. Crank angle detection signals are sent from crank angle detector 890 to controller 880. Therefore, controller 880 receives signals from crank angle detector 890 and controls the actuations of discharge device 760 and electromagnetic wave generator 840. Discharge voltage generator 950 in this embodiment is a 12-V DC power source, but this can also be a piezo element or other device. Electromagnetic wave generator 840 generates electromagnetic waves. Electromagnetic wave generator 840 in this embodiment is a magnetron that generates 2.4-GHz-bandwidth microwaves. However, this does not restrict the control method and the composition of the input-output signals as for gasket of the present invention.

Therefore, the gasket is installed between the cylinder block 100 and cylinder head 300 so that its opening 710 corresponds to the cylinder 110. A piston 200 fits into the cylinder 110 and reciprocates freely. The internal combustion engine E operating normally as a gasoline engine is assembled up. It makes possible to apply voltage between first connector 761 of the discharge line 760 and the earth member. It makes possible to feed electromagnetic waves between the second connector 781 and the earth member for a constant time. And voltage is applied to the first connector 761 of the discharge line 760 and the earthed member. The electromagnetic waves are fed to the second connector 781 of the electromagnetic wave transmission line and the earthed member at the compression stroke, when the intake valves 510 close the intake ports 310 and exhaust valves 520 closing the exhaust ports 320, in the actuation of the internal combustion engine E. Therefore, the plasma is generated near the electrode 762. This plasma receives energy of an electromagnetic waves (electromagnetic wave pulse) supplied from the antenna 770 for a given period of time. As a result, the plasma generates a large amount of OH radicals and ozone to promote the combustion. In fact electrons near the electrode 762 are accelerated, fly out of the plasma area, and collide with gas such as air or the air-fuel mixture in surrounding area of said plasma. The gas in the surrounding area is ionized by these collisions and becomes plasma. Electrons also exist in the newly formed plasma. These also are accelerated by the electromagnetic wave pulse and collide with surrounding gas. The gas ionizes like an avalanche and floating electrons are produced in the surrounding area by chains of these electron acceleration and collision with electron and gas inside plasma. These phenomena spread to the area around discharge plasma in sequence, then the surrounding area get into plasma state. In the result of the phenomena as mentioned above it, the volume of plasma increases. Then the electrons recombine rather than dissociate at the time when the electromagnetic wave pulse radiation is stopped. As a result, the electron density decreases, and the volume of plasma decreases as well. The plasma disappears when the electron recombination is completed. A large amount of OH radicals and ozone is generated from moisture in the gas mixture as a result of a large amount of the generated plasma, promoting the combustion of the mixture.

In this case, the cylinder block 100 and cylinder head 300 etc. which are the major structural materials can be used without modification compared with existing internal combustion engine. All that is required are the applying of voltage to the discharge line 760 and the supply of the electromagnetic waves. Thus, it is realized to minimize the time required to design an engine E and facilitate the sharing of many parts between existing internal combustion engines.

The material of surface layers on both sides of intermediate layer in thickness direction is not restricted in the gasket of the internal combustion engine of the present invention. The surface layers may also be a dielectric or insulator. In the gasket of the second embodiment, intermediate layer 730 is made from a dielectric, and surface layers 740 on both sides of intermediate layer 730 in thickness direction are made from a conductive material among such varied embodiments. Thus, surface layer 740 works as an earth electrode that pairs with electrode 762 of discharge line 760. The discharge is generated between electrode 762 and surface layer 740. Surface layer 740 also works as an earth conductive material that pairs with electromagnetic wave transmission line 780. The electromagnetic waves are transmitted between electromagnetic wave transmission line 780 and surface layer 740. If the intermediate layer is made from an insulator and the surface layers on both sides of the intermediate layer are made from a conductive material, the same function and effect are also gained. Moreover, if the intermediate layer is made from a dielectric or insulator and the surface layer on at least one side of the intermediate layer is made from a conductive material, the same function and effect are also gained. Additionally, the rigidity of gasket 700 improves because surface layer 740 is made from metal.

The structure and the shape of the antenna are not restricted in the gasket of the internal combustion engine of the present invention. The antenna 770 is rod-shaped as for the gasket 700 in the second embodiment among such varied embodiments. The base end of the antenna 770 is installed in the intermediate layer 730 in thickness direction. A portion, to the leading end except the base end, extends along the inner peripheral edge around the opening 710 in the circumferential direction of the opening 710 in the antenna 770. This makes it possible that the electrical field intensity near the outer edge of the combustion chamber 400, generated by the electromagnetic waves radiated from the antenna 770, is stronger than the electrical field intensity in other areas of the combustion chamber 400. Therefore, the amount of OH radicals and ozone in the vicinity of the outer edge of the combustion chamber 400 is more than the amount of other areas. Combustion in this area is promoted more than in other areas. Mixing of OH radicals or ozone and the air-fuel mixture is promoted by Squish Flow, Tumble or Swirl in the vicinity of the outside edge of the combustion chamber 400.

The positional relationship between the antenna and the electrode is not restricted in the gasket of the internal combustion engine of the present invention. Electrode 762 is located close to a portion of strong electrical field intensity in the antenna 770 due to the electromagnetic waves when the electromagnetic waves are fed to the antenna 770 in the second embodiment among such varied embodiments. This makes it possible that the electrical field intensity, due to the electromagnetic waves radiated from said portion of the antenna 770, is stronger than the electrical field intensity of the surrounding electromagnetic waves. Therefore, the energy of the electromagnetic wave pulse is intensively supplied to the plasma generated by discharge at the electrode 762. As a result, a large amount of OH radicals and ozone is efficiently generated, further promoting combustion in the area centered at the electrode 762. When there are multiple areas of the antenna 770 with strong electrical field intensity, combustion at multiple areas of the combustion chamber 400 is further promoted upon the portion approaching to the electrode 762.

Next, modifications of the gasket of the present invention will be described in the following paragraphs. In the description of the gasket of these modifications, members and portions, which fulfill the same function as the gasket 700 in the second embodiment, will be applied to the same reference characters used in the second embodiment. The description of these members and portions will be omitted. And, difference points of the composition from the gasket 700 in the second embodiment will be explained about the gaskets of these modifications. Therefore, the composition without the description is the same as the composition of the gasket 700 in the second embodiment.

Figure 10:
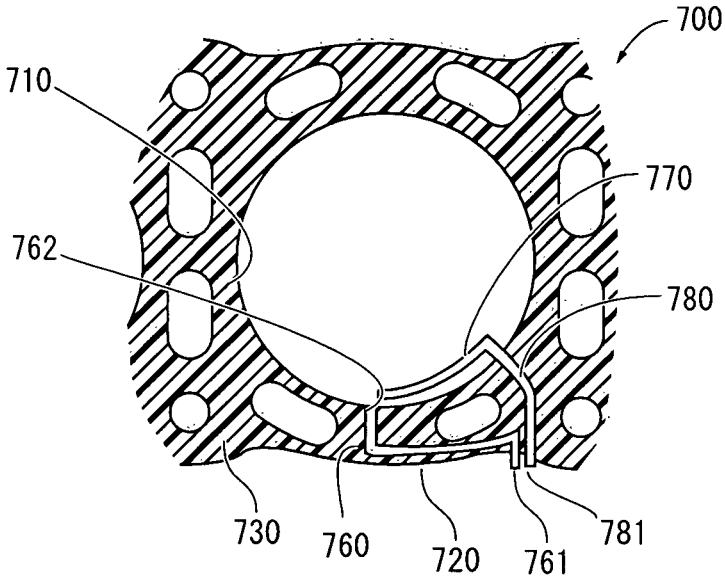
FIG. 10 shows a cross-sectional view along the surface, seen from thickness direction, of the gasket of near one opening of the gasket in the first modification of the present invention.

FIG. 10 shows the first modification of gasket 700. In the second embodiment of gasket 700, the entire length of antenna 770 is almost buried in intermediate layer 730. In the first modification, the base end of antenna 770 is located in intermediate layer 730 in thickness direction; the remainder of antenna 770 extends out from intermediate layer 730 towards the center of opening 710, and then has an L-shaped curve. The end of antenna 770 is curved in an almost circular arc, and extends along the inner peripheral edge around opening 710. Because antenna 770 of the second embodiment of gasket 700 is almost buried in intermediate layer 730 for its entire length, the heat load received from combustion chamber 400 and the fatigue of antenna 770 due to machine vibration is reduced. However, because antenna 770 is exposed to combustion chamber 400 in the first modification, the electrical field intensity due to the electromagnetic waves radiated from antenna 770 becomes stronger. Other functions and effects are similar to those described for the second embodiment of gasket 700.

Figure 11:
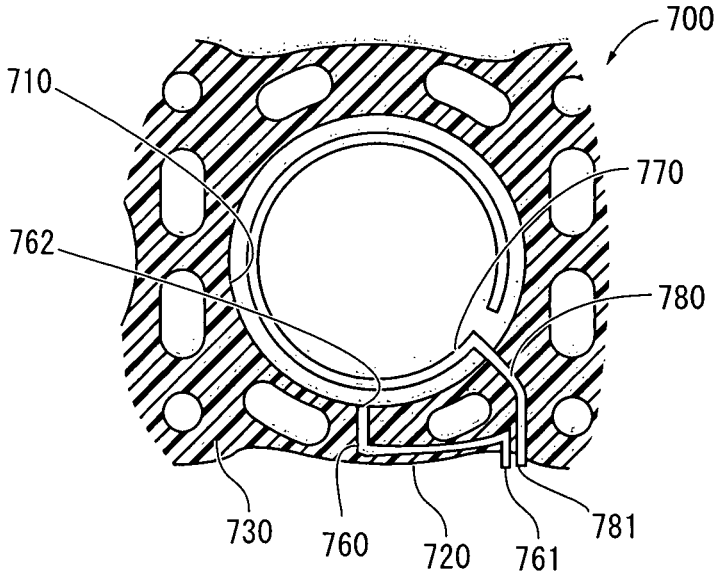
FIG. 11 shows a cross-sectional view along the surface, seen from thickness direction, of the gasket of near one opening of the gasket in the second modification of the present invention.
Figure 12:
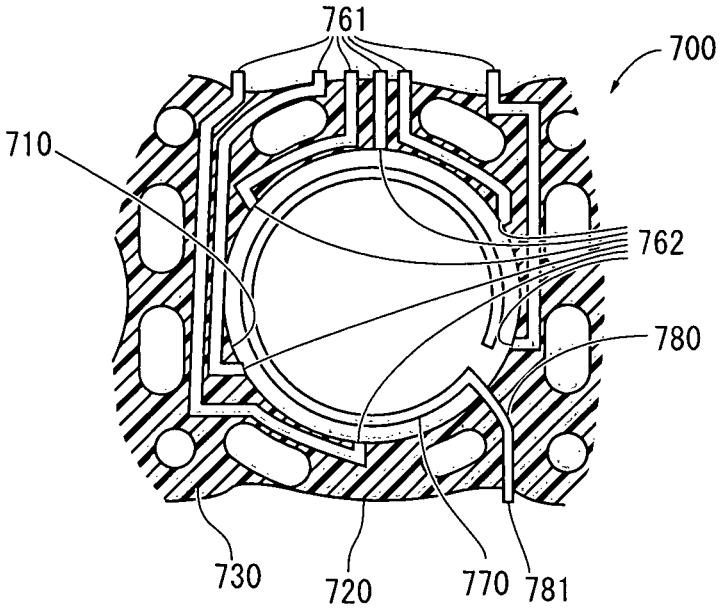
FIG. 12 shows a cross-sectional view along the surface, seen from thickness direction, of the gasket of near one opening of the gasket in the third modification of the present invention.

FIG. 11 shows the second modification of gasket 700. Here, antenna 770 of this gasket 700 is longer than one in the first modification, although both gaskets are similar. The remainder of antenna 770 extends from the base end towards the center of opening 710, and then has an L-shaped curve. The end of antenna 770 is curved in an almost circular arc, and extends along the inner peripheral edge around opening 710 for one entire loop. This makes it possible to earn the length of antenna 770 and strengthen up the electrical field intensity due to the electromagnetic waves radiated from the antenna. Other functions and effects are similar to those described for the second embodiment of gasket 700. When antenna 770 becomes long like this, the standing waves are generated in the antenna 770. Therefore, two or more portions, of which the electrical field intensity due to the electromagnetic waves becomes strong in the antenna 770, can be in existence. The portions like this are more than the gasket having shorter antenna if wavelength of electromagnetic waves are same. In the third modification of gasket 700, there are two or more electrodes 762 along the inner peripheral edge, spaced equally in gasket 700, as shown in FIG. 12, though in the first modification of gasket 700 there is one electrode 762. Each Electrode 762 is located close to area with strong electrical field intensities due to the electromagnetic waves radiated by the antenna 770. This makes it possible that the electrical field intensity, due to the electromagnetic waves radiated from said portion of the antenna 770, is stronger than the electrical field intensity of the surrounding electromagnetic waves. Therefore, the energy of the electromagnetic wave pulse from said portion is intensively supplied to the plasma generated by discharge at each electrode 762. As a result, a large amount of OH radicals and ozone is efficiently generated, further promoting combustion in the area centered at the electrode 762. Combustion at multiple areas of the combustion chamber 400 is further promoted.

In the case of third modification, a large amount of plasma beginning at each electrode 762 is generated, because there are multiple electrodes 762 of said discharge devices 760. A large amount of OH radicals and ozone are generated from moisture etc. in the gas mixture as a result of these multiple plasma, promoting the combustion of the mixture.

Moreover, ignition is caused in the vicinity of the cylinder wall when the electrodes 762 are installed in the vicinity of the cylinder wall. This deduces or prevents the generation of knocking, which originates in an uncertain factor such as pressure waves that reach the cylinder wall from the vicinity of the center of the combustion chamber.

In the multiple discharge plasma apparatus of the present invention, the order of operating the electrical discharge device etc. is not restricted. In the multiple discharge plasma apparatus in second embodiment discharge is generated by a plurality of the electrodes of the discharge devices in sequence following a predefined schedule. This makes it possible that a large amount of plasma is generated near each electrode 762. A large amount of OH radical and ozone are generated as a result of plasma. As a result, combustion of mixture is promoted in each place. These phenomena near each electrode 762 are initiated in sequence following a predefined schedule. Therefore, high-speed ignitions or combustions such as the volume ignition are initiated in sequence, and combustion reaction progresses according to this schedule.

Moreover, when discharge is generated by a plurality of the electrodes 762 sequentially with the same timing, a large amount of plasma is generated near each electrode 762 with the same timing. A large amount of OH radical and ozone are generated as a result of plasma with the same timing. As a result, combustion of mixture is promoted in each place with the same timing.

The positional relationship between the antenna and the electrodes is not restricted in the multiple discharge plasma apparatus of the present invention. Multiple electrodes 762 are respectively located close to a portion of strong electrical field intensity in the antenna 770 due to the electromagnetic waves when the electromagnetic waves are fed to the antenna 770 in the second embodiment among such varied embodiments. This makes it possible that the electrical field intensity, due to the electromagnetic waves radiated from said each portion of the antenna 770, is stronger than the electrical field intensity of the surrounding electromagnetic waves. Therefore, the energy of the electromagnetic wave pulse is intensively supplied to the plasma generated by discharge at each electrode 762. As a result, a large amount of OH radicals and ozone is efficiently generated, further promoting combustion in the area centered at each electrodes 762.

Figure 13:
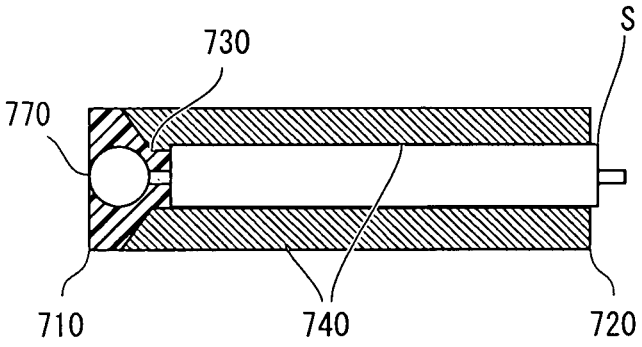
FIG. 13 shows an enlarged vertical cross-sectional view, along the electromagnetic wave transmission line, of the gasket in the fourth modification of the present invention.

FIG. 13 shows the fourth modification of gasket 700. In the second embodiment of gasket 700, not only discharge line 760 but electromagnetic wave transmission line 780 is made from copper wire. In the fourth modification, shielded cable S is installed in intermediate layer 730 and the cable core of the inner electrical cable of shielded cable S works as a an electromagnetic wave transmission line 780. Shielded cable S comprises an inner wire, an external conductive material, and an external covering. The inner wire includes a core wire made from a conductive material such as copper, and an inner covering for the core wire made from an insulator. The external conductive material is made from a conductive material that covers the inner wire. The external covering is made from an insulator that covers the external conductive material. This makes the production of the gasket comparatively easy by using the shielded cable S. Other functions and effects are similar to those described for the second embodiment of gasket 700. Shielded cable S may be installed in intermediate layer 730, and discharge line 760 may be composed of the cable core with an inner wire of shielded cable S.

Figure 14:
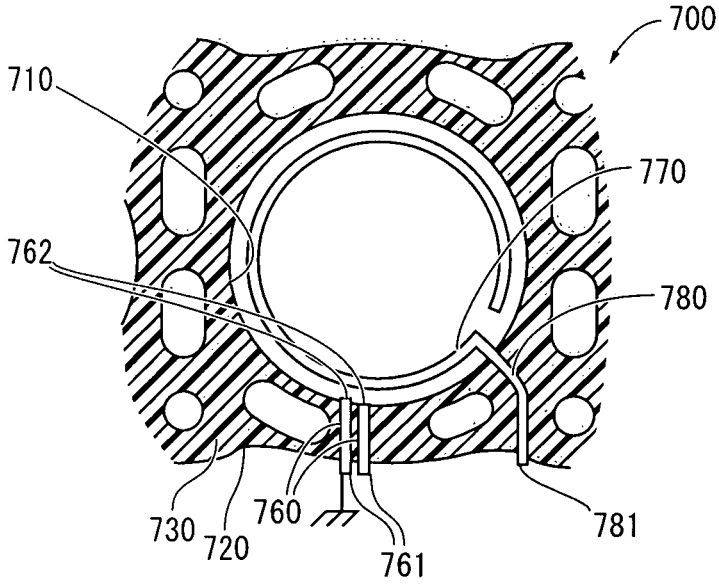
FIG. 14 shows a cross-sectional view along the surface, seen from thickness direction, of the gasket of near one opening of the gasket in the fifth modification of the present invention.

FIG. 14 shows the fifth modification of gasket 700. In the second embodiment of gasket 700, discharge line 760 is installed in intermediate layer 730 in thickness direction. The anode of voltage generator 950 is connected with first connector 761 of discharge line 760. Cylinder block 100, cylinder head 300, or surface layer 740 is earthed to become an earth member. When voltage is applied between first connector 761 and said earth member, a discharge is generated between first connector 761 and the earth member. In the fifth modification, a pair of discharge lines 760 is installed in intermediate layer 730 of gasket 700. The outside edge of each discharge line 760 is exposed from outer peripheral edge 720 of gasket 700 to become first connector 761. Moreover, the inside edge of the each discharge line 760 is exposed from the outer edge of the gasket 700 towards the center of opening 710 to become electrode 762. These electrodes 762 of discharge lines 760 are arranged adjacent to each other. This makes it possible that a discharge is generated between the electrodes when voltage is applied between first connection parts of the discharge line 760. When the electrodes 762 of these discharge lines 760 are arranged adjacent to each other, a discharge can be generated using a low voltage. And the generation of OH radicals and ozone is promoted. The duration of this generated OH radicals and ozone becomes long. Power consumption is reduced. Moreover, the amount of nitrogen oxide (NOx) in the internal combustion engine is reduced because of the reduced of temperature rise in the area where discharge is generated. Other functions and effects are similar to those described for the second embodiment of gasket 700.

In the gasket of the present invention, a pair of the electrodes or the earth member pair with this may be covered with a dielectric. In this case, the dielectric-barrier discharge is generated by voltage applied between the electrodes or between the electrode and the earth member. The dielectric-barrier discharge is restricted because charges are accumulated in the surface of the dielectric covering the electrode or the earth member. Therefore, the discharge is generated on a very small scale over a very short period of time. Thermalization does not occur in the area surrounding the discharge because the discharge is terminated after a short period of time. Therefore, the gas temperature rise due to the discharge between the electrodes is reduced, which reduces the amount of NOx produced by the internal combustion engine.

The material that installs the electromagnetic wave transmission line changes according to the material that installs the antenna, and becomes the cylinder block or a cylinder head.

The present invention includes some embodiments that combine the characteristics of the embodiments described above. Moreover, the embodiments described above are only examples of multiple discharge plasma apparatus of the present invention. Thus, the description of these embodiments does not restrict interpretation of multiple discharge plasma apparatus of the present invention.

The invention claimed is:

1. A multiple discharge plasma apparatus, which is installed in an internal combustion engine in which a piston fits into a cylinder penetrating a cylinder block to reciprocate freely, a cylinder head is assembled to the anti-crankcase side of the cylinder block with a gasket between it and the cylinder block, an intake port opening on the cylinder head is opened and closed with an intake valve, an exhaust port opening on the cylinder head is opened and closed with an exhaust valve, these parts form the combustion chamber, the multiple discharge plasma apparatus comprising:

a plurality of discharge devices, each with an electrode exposed to the combustion chamber and installed in at least one of members constituting the combustion chamber;

an antenna installed in at least one of the members constituting the combustion chamber so as to radiate electromagnetic waves to the combustion chamber;

an electromagnetic wave transmission line installed in at least one of the members constituting the combustion chamber, with one end connected to the antenna and the other end covered with an insulator or dielectric and extending to a portion, of at least one of the members constituting the combustion chamber, distant from the combustion chamber; and an electromagnetic wave generator for feeding electromagnetic waves into the electromagnetic wave transmission line;

wherein the multiple discharge plasma apparatus is configured such that discharge is generated by the electrodes of a plurality of discharge devices and the electromagnetic waves fed from the electromagnetic wave generator through the electromagnetic wave transmission line are radiated from antenna, during the compression stroke when the intake valve closes the intake port and the exhaust valve closes the exhaust port.

2. The multiple discharge plasma apparatus according to claim 1, wherein the multiple discharge plasma apparatus is configured such that discharge is generated by a plurality of the electrodes of the discharge devices in sequence following a predefined schedule.

3. The multiple discharge plasma apparatus according to claim 1, wherein the multiple discharge plasma apparatus is configured such that discharge is generated by a plurality of the electrodes of the discharge devices sequentially with the same timing.

4. The multiple discharge plasma apparatus according to claim 1, wherein the multiple electrodes are located close to multiple portions that electric field intensity generated by the electromagnetic waves strengthens in the antenna when the electromagnetic waves are fed into the antenna.

5. The multiple discharge plasma apparatus according to claim 2, wherein the multiple electrodes are located close to multiple portions that electric field intensity generated by the electromagnetic waves strengthens in the antenna when the electromagnetic waves are fed into the antenna.

6. The multiple discharge plasma apparatus according to claim 3, wherein the multiple electrodes are located close to multiple portions that electric field intensity generated by the electromagnetic waves strengthens in the antenna when the electromagnetic waves are fed into the antenna.

* * * * *